United States Patent [19]

Barr

[11] 3,988,415

[45] Oct. 26, 1976

[54] RECOVERY OF PRECIOUS METAL VALUES FROM ORES

[76] Inventor: William Morrison Barr, 1512 S. 19th East, Salt Lake City, Utah 84108

[22] Filed: July 22, 1974

[21] Appl. No.: 490,354

Related U.S. Application Data

[63] Continuation-in-part of Ser. No. 369,920, June 14, 1973, abandoned.

[52] U.S. Cl. ..... 423/22; 423/44; 423/491; 75/83; 75/113

[51] Int. Cl.[2] ..... C01G 55/00; C01G 5/00; C01G 7/00

[58] Field of Search ..... 423/22, 44, 46, 491; 75/83, 113

[56] References Cited

UNITED STATES PATENTS 3,021,209 2/1962 Murray et al. ..... 75/113 X 3,049,422 8/1962 Wolcuth ..... 75/113 X

FOREIGN PATENTS OR APPLICATIONS 22,549 9/1901 United Kingdom ..... 75/113

*Primary Examiner*—Herbert T. Carter

*Attorney, Agent, or Firm*—Oblon, Fisher, Spivak, McClelland & Maier

[57] ABSTRACT

A process for the recovery of precious metal values from ores whereby the ore, in particulate form is heated with a mixture of solid (dry) chloride and nitrate salts, in the absence of oxygen. The precious metal values are recovered in the form of the corresponding chlorides which are removed from the system by sublimation or vaporization. The chlorides of the precious metal values are then trapped, separated and can be reduced by conventional methods. Gold, silver and platinum are particularly amenable to recovery from complex ores by this method.

10 Claims, No Drawings

RECOVERY OF PRECIOUS METAL VALUES FROM ORES

CROSS REFERENCES TO RELATED APPLICATIONS

This is a continuation-in-part of application Ser. No. 369,920 filed June 14, 1973 and now abandoned.

BACKGROUND OF THE INVENTION

1. Field of the Invention

This invention relates to a method for the recovery of precious metal values from ores, concentrates, tailings and other products from mining and metallurgical operations. More particularly, this invention relates to a method of treatment of complex metal ores to enable the recovery of the precious metal values. The term "precious metals" to which this invention is primarily applicable, is generally understood to include, gold, silver, platinum and the metals of the platinum group, including osmium, ruthenium, iridium, palladium, and rhodium. In accordance with this invention these metals may be extracted from ores in percentages heretofore impossible or not economically advantageous.

2. Description of the Prior Art

It is well known that the precious metals such as gold, silver and platinum occur very often in the natural state, tied up in very complex ores. Often, for example, the precious metals occur in complexes either singly or in combination with iron, selenium, tellurium and other elements. These have proven extremely difficult to separate. Most of the standard mineral recovery processes do not work very well and result in uneconomic yields.

Presently, precious metals are most often recovered from their ores by smelting or through a cyaniding process whereby the ore is treated with cyanide compounds usually in an alkaline medium to complex out the precious metals. This is generally followed by separation of the precious metal bearing cyanide solution and precipitation of the cyanides or by addition of a carbonaceous, sorbent material followed by flotation and reduction of the cyanide concentrate.

Cyanidation processes have several inherent disadvantages, not the least of which is the poisonous nature of cyanide compounds and the accompanying difficulty of working with them. Further, the flotation process is not a particularly efficient method for the collection of precious metals and requires expensive equipment. Nor, when many precious metals occur together in the same ore is the separation of the cyanides an easy matter. Smelting, on the other hand, has the disadvantage that many of the precious metal values are lost, probably through escape through the stack. In any case, the prior art methods have never been economically or practically feasible when the ores are complex or do not contain the desired metals in large amounts. Recovery percentages are generally low.

It has long been well known that aqua regia is a solvent for most of the precious metals and leaching with aqua regia has long been used in the extraction of precious metals, particularly gold, silver and platinum from their ores. However, using ordinary aqua regia is not feasible with a complex ore because even heated aqua regia is not a particularly good solvent for complex ores. Further, while it was known that the hotter the aqua regia, the more efficient the extraction process would be, ordinary aqua regia boils at too low temperature to be serviceable. Still further, extraction of a complex ore with aqua regia yields a complex solution of chlorides and oxides which is extremely difficult to separate.

Those concerned with the separation of precious and noble metals, particularly gold, silver and platinum from complex ores, have long been desirous of a relatively simple, economically feasible process for the recovery of these metals. Especially, a process has been desired that did not have the dangers and disadvantages of cyanidation and the inefficiency associated with extraction with aqua regia.

It was reported in British Pat. No. 22,549 to recover precious metals from ores by combining a halide salt, nitrate salt, refractory metalloid and a free supply of air. The yield of recovered precious metal values using that technique is quite low and does not even rival more conventional techniques.

SUMMARY OF THE INVENTION

Accordingly, it is an object of the present invention to provide a simple, economically feasible method for the extraction of a variety of precious and noble metals from ores, tailings and other mining products.

Another object of the invention is to provide for the extraction and separation of these metals without the disadvantages inherent in the prior art methods of cyanidation, smelting, and ordinary aqua regia extraction.

A further object is to provide a method whereby particularly gold, silver, platinum and the metals of the platinum group including osmium, ruthenium, iridium, palladium and rhodium can be economically removed from complex ores.

Still a further object is to retain the advantages of the use of aqua regia in the extraction of precious metals from ores while improving the process to overcome prior art disadvantages, particularly the low boiling point and difficulty of separating the resulting complex solutions.

These and other objects are achieved in one aspect of the present invention by a process which involves heating the ore in a dry, particulate state with a dry, particulate mixture of nitrate and chloride salts in the absence of air. This combination of salts acts to chlorinate the ore after which the precious metal chlorides are separated by vaporization or sublimation.

These and other objects, features and advantages of the invention will become more fully apparent to those skilled in the art from the following description and examples of preferred embodiments of the invention which are presented by way of example and not by way of limitation.

DESCRIPTION OF THE PREFERRED EMBODIMENTS

This process may be practiced on any known precious metal containing ores, many from which precious metal values have not been recoverable in the past. For instance, recovery of gold, silver, platinum, osmium, ruthenium, iridium, palladium and/or rhodium is possible by the methods of this invention. The term "ores" is intended to include tailings, concentrates, slags or other smelting and refining residues, as well as any or all precious metal bearing rock, mineral or soils such as sulphide ores, black sands, telluride ores, selenide ores, quartzes, porphyry, monzanite, grandorite, etc.

Recovery according to this invention occurs by reaction of the salts with the precious metal values, particularly by chlorination and/or oxidation. The ore and dry nitrate-chloride mixture is heated to a sufficiently high temperature to effect chlorination of the precious metal values. The resulting precious metal chlorides are then separated by sublimation or vaporization.

A typical reaction using gold as the illustrative precious metal for extraction, is as follows:

$$AuTe_2 + 3NH_4NO_3 + 12\ NH_4Cl \rightarrow NH_4AuCl_4 + 2(NH_4)_2\ TeCl_4 + 10NH_3 + 5H_2O + 2NO + NO_2$$

These complex chlorides decompose further to yield the gold chlorides, facilitating separation. The vaporizates or sublimates are easily collected and separated, yielding the individual precious metal chlorides which can then either be reduced to the elemental metal or are marketable as the chloride.

It is important that the reaction be carried out in the absence of oxygen which seem to have an effect by reducing the percent recovery of precious metal values. This can be carried out by substituting the air in the heating unit with an inert gas. It can more easily be accomplished however, by expelling the air from the furnace system by the initial quantities of vaporized chloride gases. In this latter instance, it is only necessary to use a relatively small size furnace, as compared with the size of the ore sample being treated, and to use a closed system which effectively excludes the entrance of additional quantities of air into the system.

The nitrate and chloride mixture required for the operation of this invention may be in the form of any nitrate or chloride salts or any compounds, organic or inorganic, which upon reaction or decomposition yield the nitrate or chloride ion. For example, and not by way of limitation, the nitrate ion could be derived from ammonium nitrate, potassium nitrate, sodium nitrate, aluminum nitrate, lead nitrate, ferric nitrate, or the organic complex trinitro-triphenyl-bismuth-dinitrate. Similarly, chloride could be derived from ammonium chloride, potassium chloride, sodium chloride, berylium chloride, or the organic complex tricyclohexyl-germanium chloride.

While, as noted, any combination of the nitrate and chloride compounds could be used, it is preferred that one or both be the ammonium salt.

While not wishing to be bound by any particular theory of the invention, it appears that the ammonium salts offer advantages in that excessive temperatures are not required for the reaction. Further, by using ammonium salts no unnecessary metals or extraneous organic materials are introduced, as the ammonium goes off as ammonia gas.

The ratio of nitrate-chloride mixture to ore used in this process is not critical and may range from 1 part nitrate-chloride mixture to 10 parts ore, to 10 parts of nitrate chloride mixture to 1 part of ore. While as much nitrate-chloride mixture per part of ore may be used as desired, it will be obvious to one skilled in the art that a sufficient amount of nitrate-chloride mixture should be present, to allow for complete reaction. In the event that the amount of nitrate-chloride mixture is not sufficient to insure complete reaction, as would be determined by assaying the residue for precious metal content, the process may simply be repeated using a fresh charge of the nitrate-chloride mixture. The process can obviously be adapted for continuous operation.

The use of too much nitrate-chloride mixture in relation to the amount of ore present would be uneconomical, but would cause no other particular difficulties. It has been determined by experimentation on various types of ores, that a range of from 0.5 parts by weight of nitrate-chloride mixture per part of ore to 2 parts of nitrate-chloride mixture per part of ore will be most efficient with a ratio of 1:1 by weight being preferred. These ratios can serve as a starting point for extractions of any ore. The optimal ratio for any given ore will be easily determined by experimentation, and is within the skill of the art.

Similarly, the proportion of nitrate to chloride in the extracting mixture is not critical. Ordinary wet aqua regia is made up of three parts (moles) of hydrochloric acid to one part (moles) of nitric acid or approximately 1.8:1 by weight. The mixture of so-called "dry aqua regia," which is used in this invention, could be made up the same way on a three to one molarity ratio, which is the equivalent of approximately at 2:1 weight ratio. Obviously, it would be well to have a sufficient excess of chloride to insure chlorination of all of the precious metal present. While in theory the stoichiometric amounts could be used, in practice the excess of chloride is desirable to insure complete reaction. The suitable range of chloride to nitrate salts is from 0.5 to 10 parts of chloride per part of nitrate by weight. It has been found in practice, especially when using the ammonium salts that 1 to 3 parts of chloride by weight per part of nitrate gives optimal results while making the most efficient use of material. This range is preferred with a 1:1 ratio being a good starting point.

The nitrate and chloride compounds used need not be in any special form but may be the commercially available reagent grade, USP grade, or in case of the ammonium salts, even technical or fertilizer grade.

The chlorinating process may be carried out in any type of chloride resistent, heated reaction vessel. For example, a stainless steel vessel in an electric furnace, or an externally heated rotary kiln with a porcelain liner. A rotary kiln assures the complete mixing necessary for efficient chlorination.

In the event that there is iron present in significant quantities in the starting material it will be helpful to first run the ore through a ball mill with hydrogen peroxide. This oxidizes the iron which can then be separated with a Dings Roller. If there is a significant amount of sulfide present, the ore may be pre-fired in a hydrogen flame to remove the sulphide.

The ore and nitrate-chloride salt mixture are generally ground or crushed to a small particle size, for example, 4 mesh or finer, or 50 mesh or finer preferred. As will be obvious, larger particle sizes can be used, but the reaction is more efficient with smaller particle sizes. The ore and nitrate-chloride mixture should be mixed, for example, in a cement mixer, ball mill or the like, or may be mixed and ground to the desired particle size in the same operation.

The vessel is charged with the ore and the mixture of dry nitrate and chloride salts. The temperature is not critical so long as it is high enough to effect the reaction. The reaction begins at about 240° F and in a closed system the initial quantities of air present in the furnace will be driven off. Generally a temperature range of from 400° F to 1600° F will give the desired results. Too high a temperature may only cause other undesired reaction products to be driven off with the precious metal chlorides and may make separation more difficult. A range of from 1000° F to 1500° F is preferred.

The temperature in the vessel may initially be set at 300° F for approximately 30 minutes to drive off any water present as well as any other low boiling material. The temperature may then either be raised in stages to allow for or it may be raised at once to approximately 1000° F at which temperature most of the desired metal chlorides will be driven off. The choice will mostly depend on the subsequent collection and separation methods to be employed.

In any case, the mixture is heated to a temperature sufficient for reaction. To recover all precious metal values the temperature should be taken up to between 1000° F and 1500° F. At these temperatures most of the gold and platinum chlorides will be driven off. The silver chlorides will stay behind in the residue. While the best operating temperatures may vary somewhat for the particular sample, and will have to be determined experimentally, generally, taking the temperature up to between 1000° F and 1500° F will give the best results.

Heating or residence time is again not critical beyond a sufficient length of time to allow for complete reaction and sublimation. Generally, from 30 minutes to 3 hours is necessary with from 1 to 2 hours being the preferred range of residence time. Two hours at the operative temperature has been found to be optimum to insure completion of the reaction. The reaction is generally conducted at ambient pressure.

The reaction products which are driven off may be collected any number of ways. The preferred method is by bubbling the gases into one or a series of traps or scrubbers containing a slightly acidic aqueous solution. Alternately, the sublimate could be collected as a solid by standard condensing methods. In the event that the chlorides are to be fractionated in stages, a series of called sublimation traps would be necessary to be moved into place as required.

SEPARATION AND REDUCTION

Silver, gold and platinum are of the most value and it will generally be desired to reduce them to their elemental states. If the reaction is carried out as described and the product led to a water scrubber, the resulting scrubbing solution will be rich in the gold and platinum chlorides and any chlorides present of the platinum group. The silver chloride will remain in the reaction vessel. At this point separation and reduction may be accomplished by methods well within the skill of the art.

One method for separation is as follows:

The pregnant liquor is treated with zinc shavings which cause the precious metal compounds to precipitate out. This precipitate is then dissolved in aqua regia. Oxalic acid is added to precipitate out the gold as the oxalate followed by formic acid to precipitate the platinum as the formate. These are easily reduced to the metal.

The residue left in the reaction vessel should be rich in silver chlorides and can also be extracted by standard smelting methods. Alternatively, washing and filtration will remove most other chlorides and the silver chloride may then be dissolved in ammonium hydroxide. Addition of hydrogen peroxide to the filtrate forms a silver sponge from which the metal can easily be obtained.

EXAMPLES

Having now generally described the invention, the following examples are presented by way of illustration in order to obtain a better appreciation thereof. Unless otherwise indicated, these examples are for illustration only and are not intended to be limiting in any way.

EXAMPLE 1

A sample of eighty grams of quartzite ore was ground to 150 mesh and split into two forty gram samples. One of these samples are analyzed according to standard, liquid aqua regia extraction methods followed by analysis on an atomic absorption unit. The other 40 gram sample was charged into a furnace with twenty grams ammonium chloride and twenty grams of ammonium nitrate. The furnace was a batch type furnace having a 8 × 14 inch chamber which was sealed to the atmosphere.

The mixture was slowly heated to 240° F at which the initial chemical reaction was seen to occur, which had the effect of flushing the residual oxygen from the furnace. As the temperature was further raised to 240° F, gases were taken in a closed system directly to a circulating system of 6800 milliliters of water to which had been added 20 milliliters of hydrochloric acid. The resulting chlorides dissolved readily in the solution. The reaction was continued for 2 hours at 800° F.

From this point the separation was conventional. The pregnant liquor was treated with zinc shavings and decanted. It was then filtered and the resulting filter cake was dissolved with aqua regia. The gold values were precipitated out by titrating with oxalic acid until no more precipitate formed. After recovery of the gold, the solution was again titrated with formic acid until no more precipitate formed, and the platinum values filtered out. The residue in the reaction vessel was analyzed for silver.

The original aqua regia assay of the samples before treatment showed the following values indicating the amount recoverable by standard methods:

Gold 0.0326 oz/ton
Silver 0.6447 oz/ton
Platinum 0.0190 oz/ton

The amount recovered after subjecting the sample to the process of the present invention was as follows:

Gold 0.1157 oz/ton
Silver 0.7736 oz/ton
Platinum 0.227 oz/ton

EXAMPLES 2 THROUGH 11

In the following examples 80 gram samples of various ores were split into 2 equal parts and processed as in Example 1. In each case the temperature was slowly raised from ambient to 1000° F for approximately 2 hours and finally to 1500° F for one hour additional to insure complete reaction. Both rotary kiln and furnace heated reaction vessels were employed.

| Example No. | Gold (gms × $10^{-5}$) | Silver (gms × $10^{-5}$) | Platinum (gms × $10^{-5}$) |
|---|---|---|---|
| 2. Before Processing | 0.64 | 2.0 | 0.641 |
| After Processing | 8.57 | 2.78 | 1.36 |

-continued

| Example No. | | Gold (gms × $10^{-5}$) | Silver (gms × $10^{-5}$) | Platinum (gms × $10^{-5}$) |
|---|---|---|---|---|
| | % Increase Recovery | 1339% | 102% | 305% |
| 3. | Before Processing | 4.48 | 88.4 | 2.60 |
| | After Processing | 15.9 | 106.0 | 31.1 |
| | % Increase Recovery | 355% | 120.0% | 1195% |
| 4. | Before Processing | 44.7 | 6.4 | 5.97 |
| | After Processing | 57.1 | 20.3 | 12.7 |
| | % Increase Recovery | 128% | 317% | 212% |
| 5. | Before Processing | 0.720 | 4.40 | 1.3 |
| | After Processing | 3.65 | 28.2 | 6.73 |
| | % Increase Recovery | 507% | 641% | 510% |
| 6. | Before Processing | 0.24 | 4.40 | 2.14 |
| | After Processing | 9.49 | 4.75 | 10.5 |
| | % Increase Recovery | 3953% | 108% | 491% |
| 7. | Before Processing | 4.48 | 88.4 | 2.60 |
| | After Processing | 13.5 | 111.0 | 3.22 |
| | % Increase Recovery | 300% | 125% | 124% |
| 8. | Before Processing | 0.64 | 2.0 | 1.36 |
| | After Processing | 3.24 | 17.0 | 2.60 |
| | % Increase Recovery | 506% | 852% | 191% |
| 9. | Before Processing | 0.40 | 0.40 | 6.08 |
| | After Processing | 8.64 | 1.61 | 10.67 |
| | % Increase Recovery | 2160% | 403% | 175% |

In brief summary, the process of the present invention has been found to be extremely useful in the recovery of metals from their ores and especially to recovery in economic quantities of the precious and noble metals such as gold, silver and platinum. Accordingly, while the foregoing disclosure relates only to preferred embodiments, it will be appreciated that the invention is equally applicable to the recovery of other metals and that numerous modifications and alterations may be made by those skilled in the art without departing from the spirit and scope of the invention as set forth in the appended claims.

What is claimed as new and desired to be secured by Letters Patent of the United States is:

1. A process for the recovery of metals selected from the group consisting of gold, silver, platinum and members of the platinum group from ores containing these metals, which comprises:

admixing with the ore, a mixture of dry chloride and nitrate compounds which upon reaction with the ore or which by thermal decomposition yield the chloride and nitrate ion, respectively, heating said mixture in the absence of air and oxygen to a temperature of from 400° F to 1600° F, to effect reaction of the metal values with said compounds and volatilization of products, collecting the volatilized products, separating the desired metal values therefrom, and further separating from the non-volatilized residue any of said metal values contained therein.

2. The process of claim 1, wherein from 0.5 parts by weight to 2 parts by weight of nitrate-chloride mixture is admixed per part of ore.

3. The process of claim 1 wherein the chloride and nitrate compounds are ammonium chloride and ammonium nitrate, respectively.

4. The process of claim 3 wherein the mixture of ammonium chloride to ammonium nitrate is in the ratio of approximately from 1 part by weight of ammonium chloride to 1 part by weight of ammonium nitrate, to approximately 3 parts by weight of ammonium chloride to 1 part of ammonium nitrate.

5. The process of claim 1, wherein the volatilization is effected by vaporization.

6. The process of claim 1, wherein the volatilization is effected by sublimation.

7. The process of claim 1 wherein said non-volatilized residue contains silver values.

8. A process for the recovery of metals selected from the group consisting of gold, silver, platinum and members of the platinum group, which comprises admixing with an ore containing values of said metals a mixture of dry ammonium chloride and ammonium nitrate, heating said mixture in the absence of air and oxygen to a temperature of from 400° F to 1600° F, to effect the reaction of the metal values with said nitrate and chloride and volatilization of products, collecting the volatilized products, separating the desired metal values therefrom, and further separating from the nonvolatilized residue any of said metal values contained therein.

9. The process of claim 8 wherein the metal values to be recovered are selected from the group consisting of gold, silver and platinum.

10. The process of claim 8 wherein from 0.5 to 2 parts by weight of a mixture of approximately equal parts by weight of ammonium nitrate and ammonium chloride is admixed per part of ore.

* * * * *